US006746337B1

(12) United States Patent
Tipaldo

(10) Patent No.: US 6,746,337 B1
(45) Date of Patent: Jun. 8, 2004

(54) RETRACTABLE TARGET MARKER

(75) Inventor: John M. Tipaldo, 405 Beach 132 St., Belle Harbor, NY (US) 11694

(73) Assignee: John M. Tipaldo, Belle Harbor, NY (US)

( * ) Notice: Subject to any disclaimer, the term of this patent is extended or adjusted under 35 U.S.C. 154(b) by 0 days.

(21) Appl. No.: 10/294,012

(22) Filed: Nov. 14, 2002

(51) Int. Cl.[7] ..... A63B 69/36; A63B 57/00

(52) U.S. Cl. ..... 473/150; 473/407; 52/103; 116/209

(58) Field of Search ..... 473/405, 407, 473/131, 150; 116/209; 52/103, 104

(56) References Cited

U.S. PATENT DOCUMENTS 661,830 A * 11/1900 Webster ..... 52/104
2,610,502 A * 9/1952 Carlson ..... 52/103
2,624,307 A * 1/1953 Caffrey ..... 116/63 R
4,502,258 A * 3/1985 Rushing ..... 52/103
5,340,103 A * 8/1994 Kirby et al. ..... 473/150
5,357,897 A * 10/1994 Bailey ..... 116/209
6,099,139 A * 8/2000 Lapensee ..... 362/153.1
2002/0142866 A1 * 10/2002 Wallerstein ..... 473/407

* cited by examiner

*Primary Examiner*—Mark S. Graham

(57) ABSTRACT

A retractable target marker is a device designed to provide golfers the ability to aim at a visible target when practicing in an open field. The device has been designed to withstand reasonable winds through the use of a retractable support element and a colored casing made from a compressible sheer, fishnet or nylon material. Contained within the retractable support element is a retractable arm that allows for the device to easily expand to height visible by golfers over several hundred yards away when in operation. The retractable support element also contains a lower extension that is placed within the ground during operation. The retractable target marker is designed to store compactly when not in use.

3 Claims, 6 Drawing Sheets

RETRACTABLE TARGET MARKER

BACKGROUND AND SUMMARY OF THE INVENTION

This application relates to a means of providing golfers with an improved method of marking their target when practicing in an open field or park.

Currently, golfers may employ traffic cones, flags or other similar devices as a target when practicing. A common problem with these devices is the excessive storage space required when not in use. The present invention has been designed to provide the golfer with a targeting device that is capable of being easily stored within a small compartment of their golf bag.

The Retractable Target Marker is a combination of two pieces. The first piece is a retractable support element. The second piece is brightly colored casing which is connected to the retractable support element. In addition, the present invention has been designed so that two units may be compactly stored as one.

The retractable support element consists of a retractable arm that is connected to a lower portion and an upper portion. The retractable arm is intended to function in a manner similar to that of an antenna. On the rear side of the lower portion of the retractable support element is a lower extension. When the present invention is in use, lower extension is placed into the ground. On the front side of the lower portion there is a slot that is designed to receive the lower extension of another unit. When the present invention is not in use, the lower extension of one unit is slid into the slot of another unit thereby combining the two units as one for compact storage. Also contained within the lower portion of the retractable support element is a continuous notch encircling the lower portion. The purpose of this feature is to allow the lower portion of the casing to be held in a fixed position when placed over the retractable support element. Within the upper portion of the retractable support element is also a continuous notch. This indentation allows the upper portion of the casing to be held in fixed position on the upper portion of the retractable arm.

The second piece of the present invention is a casing. The casing is made of a porous cloth or nylon type material similar to netting. The purpose of using a porous material is to allow for the wind to pass through the device thus significantly diminishing the total wind load to be withstood. The casing itself may be colored fluorescent orange or another similarly bright color and is sized to coincide with the length of the retractable arms in the expanded position. The casing also consists of rubber bands or other similar type banding devices contained within each end. The casing is held in place on the retractable support element by inserting the rubber-banded ends into the continuous notches on the upper and lower portions of the retractable support element.

The Retractable Target Marker has been designed for easy placement during operation. The first step in the application process is to place the lower extension of the retractable support element into the ground. Once the lower extension is firmly in the ground the user grasps the upper portion of the retractable support element and pulls in vertical direction fully exposing the retractable arm. When the retractable arm is fully extended the invention is ready for application.

BRIEF DESCRIPTION OF THE DRAWINGS

The subject matter which is regarded as the present invention is particularly pointed out and distinctly claimed in the concluding portion of the specification. The invention, however, both as to organization and method of practice, may be best understood by reference to the detailed description, taken in conjunction with the accompanying drawings, in which:

DETAILED DESCRIPTION OF PREFERRED EMBODIMENTS

Figure 1:
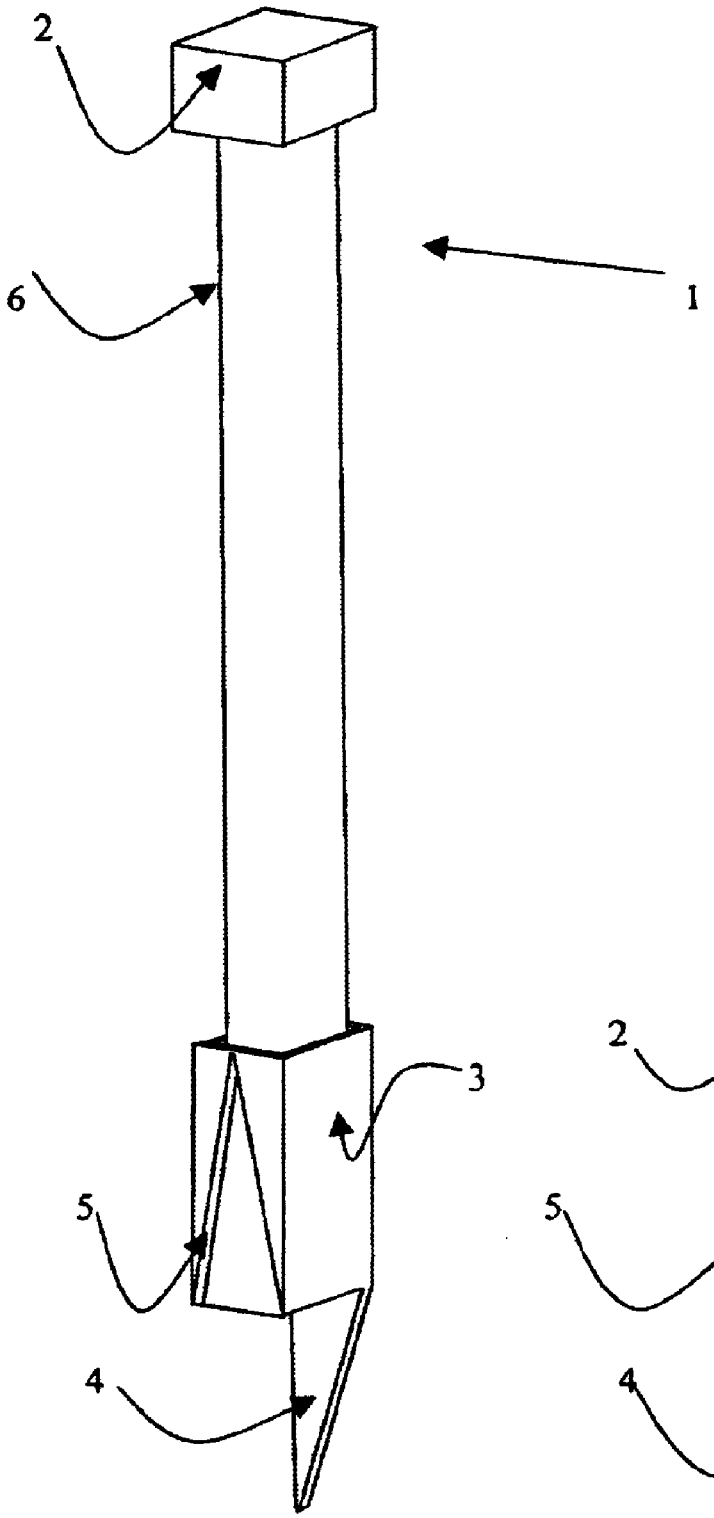
FIG. 1 is a perspective view of the present invention in the "open" position.
Figure 2:
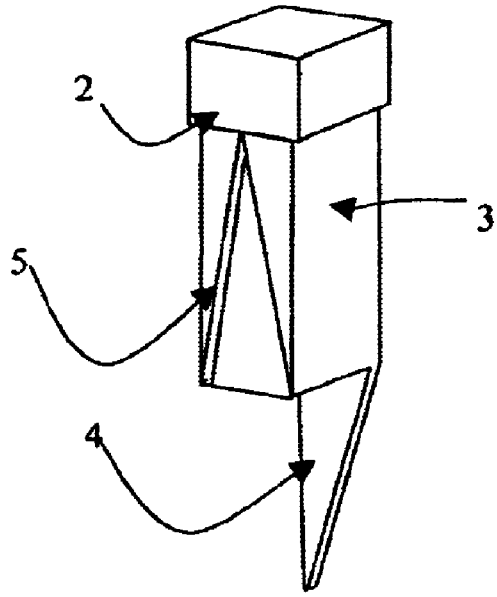
FIG. 2 is a perspective view of the present invention in the "closed" position.
Figure 3:
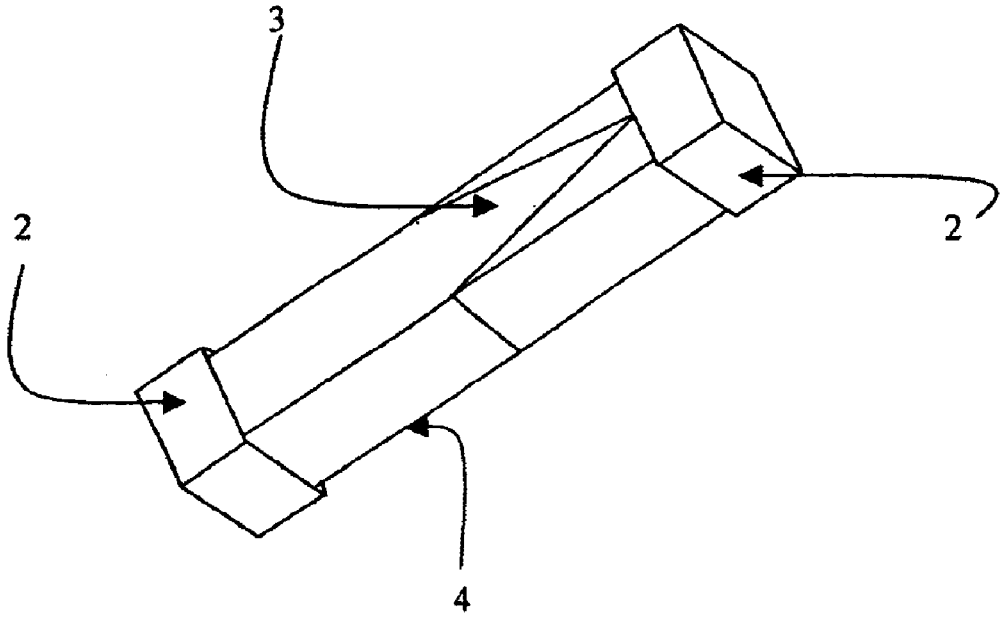
FIG. 3 is a perspective view of the present invention in the joined "closed" position.
Figure 4:
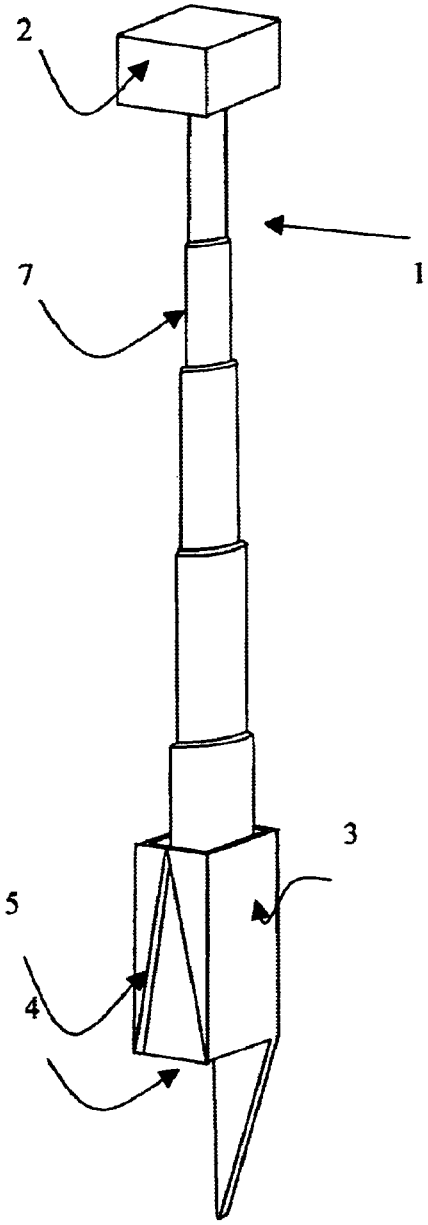
FIG. 4 is a perspective view of the retractable support element in the "open" position.
Figure 5:
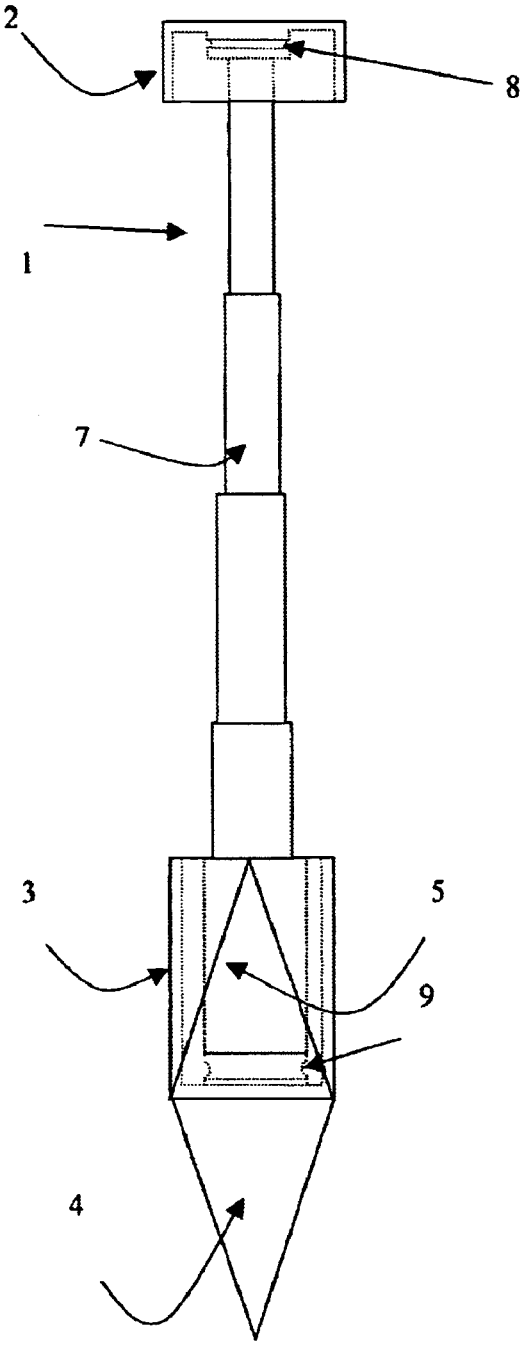
FIG. 5 is a plan view of the retractable support element in the "open" position.
Figure 6:
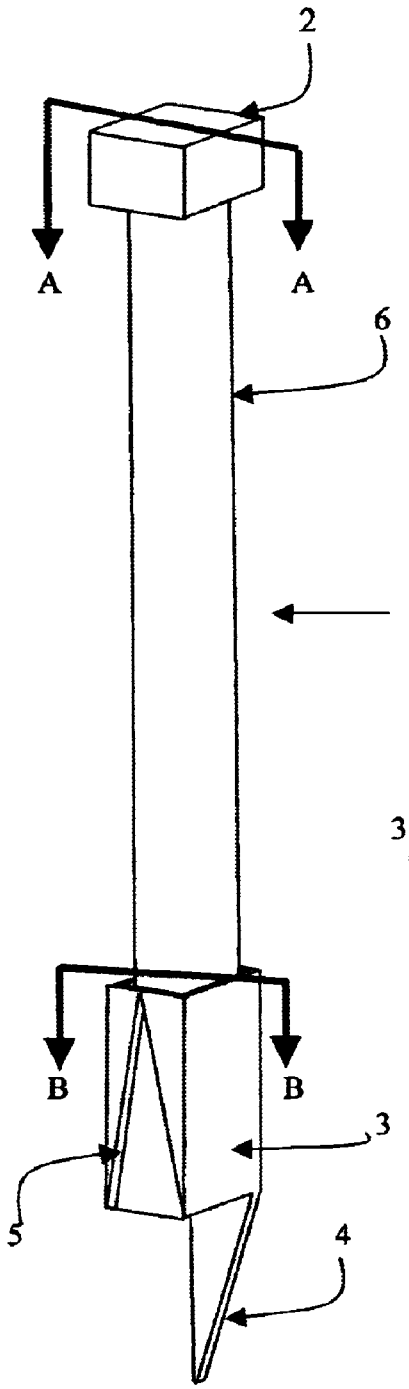
FIG. 6 is a perspective view of the present invention illustrating cross sectional lines A—A and B—B
Figure 7:
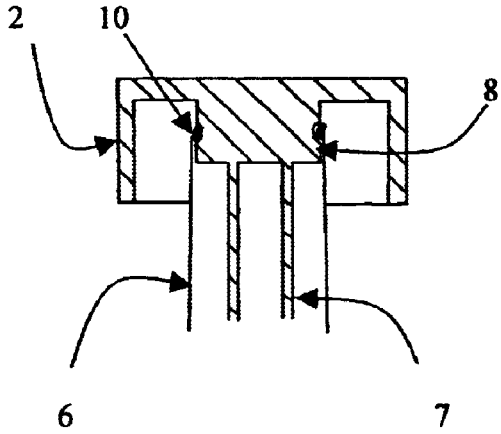
FIG. 7 is a cross sectional view along line A—A from FIG. 6 detailing the upper portion of the retractable support element.
Figure 8:
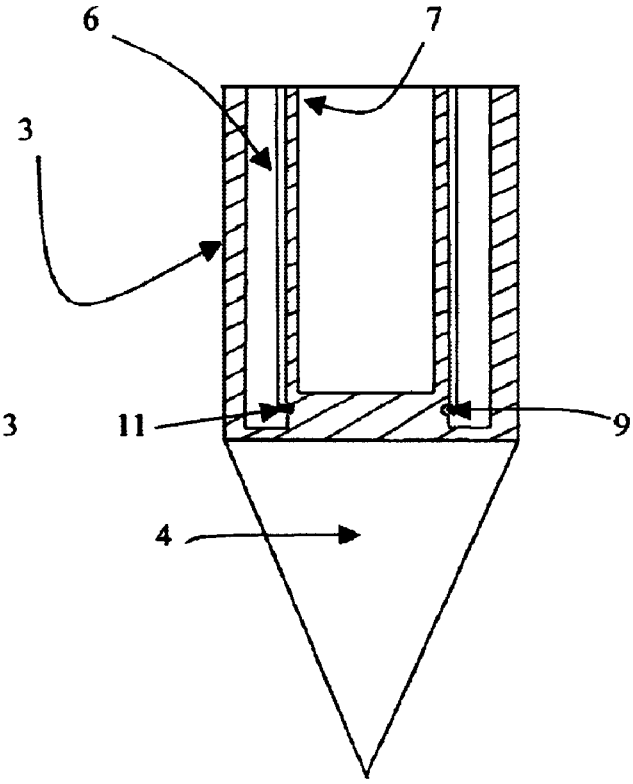
FIG. 8 is a cross sectional view along line B—B from FIG. 6 detailing the lower portion of the retractable support element.

The present invention consists of two distinct pieces that are joined together. The first piece is a retractable support element (1). FIG. 4 illustrates a perspective view of the retractable support element (1) in the "open" position. FIG. 2 illustrates a perspective view of the present invention in "closed" position. The retractable support element (1) is comprised of an upper portion (2), a retractable arm (7), a lower portion (3) and a lower extension (4). FIG. 5 illustrates a plan view of the retractable support element (1). FIG. 6 illustrates a perspective view of the retractable support element (1) in the "open" position showing cross sectional lines A—A and B—B. As illustrated in FIG. 7, contained within the upper portion (2) is an upper continuous notch (8). As illustrated in FIG. 8, contained within the lower portion (3) is a lower continuous notch (9). The upper portion (2) and the lower portion (3) of the retractable support element (1) are joined together by a retractable arm (7). Located on the rear side of the lower portion (2) is a lower extension (4). The location of the lower extension (4) is illustrated in FIG. 1. The lower extension (4) is to be placed into the ground during deployment of the present invention. Located on front side of the lower portion (3) is a slot (5). FIG. 2 illustrates the location of the slot (5) on the lower portion (3). The slot (5) is designed to receive the lower extension (4) of a corresponding device. FIG. 3 illustrates the connection of the slot (5) of one device and the lower extension (4) of another device thereby joining the two separate devices. This combination allows for two separate devices to be stored as a single unit.

Figure 10:
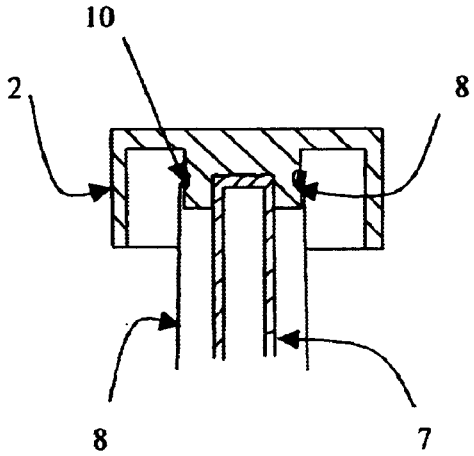
FIG. 10 is a cross sectional view along line A—A from FIG. 6 detailing the "press-fit" connection between the upper portion and the retractable arm.
Figure 12:
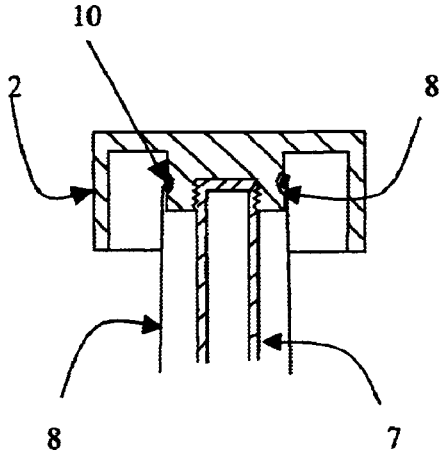
FIG. 12 is a cross sectional view along line A—A from FIG. 6 detailing the "threaded" connection between the upper portion and the retractable arm.
Figure 11:
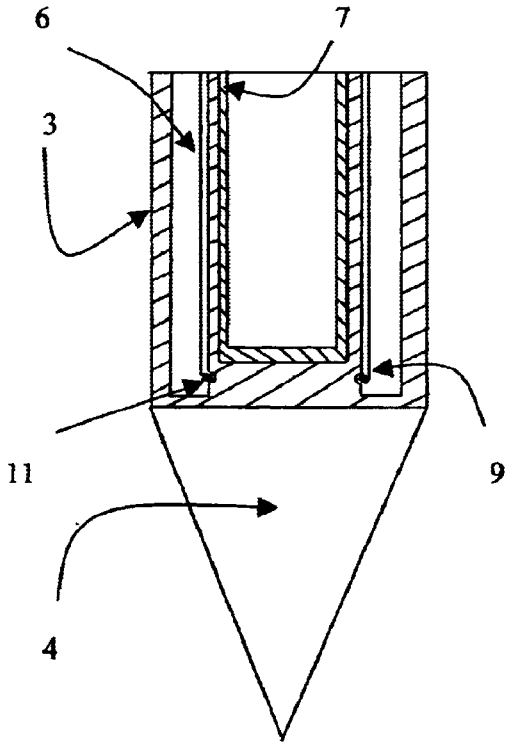
FIG. 11 is a cross sectional view along line B—B from FIG. 6 detailing of the "press-fit" connection between the lower portion and the retractable arm.
Figure 13:
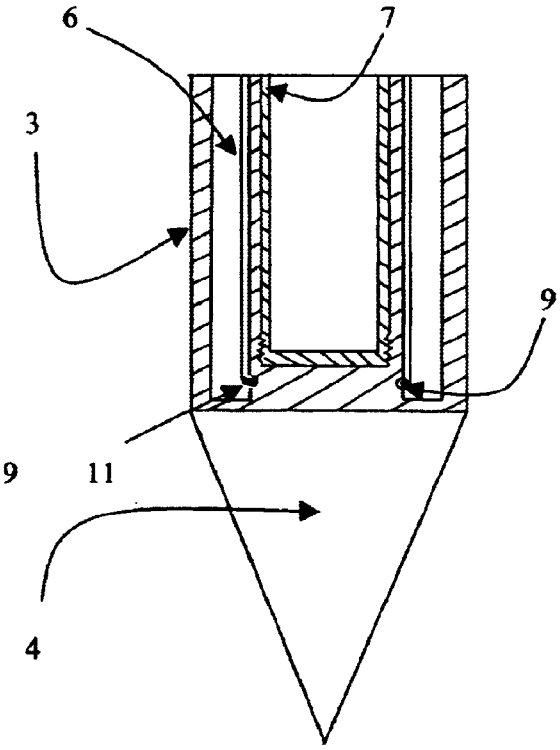
FIG. 13 is a cross sectional view along line B—B from FIG. 6 detailing the "threaded" connection between the lower portion and the retractable arm.

The retractable support element (1) may be composed of a single pre-fabricated element or constructed by combining an individual upper portion (2), retractable arm (7) and lower portion (3) by either "press-fit" or "threaded" type connections. These connections are illustrated in FIGS. 10 and 11 for the "press-fit" connection or FIGS. 12 and 13 for the "threaded" connection.

Figure 9:
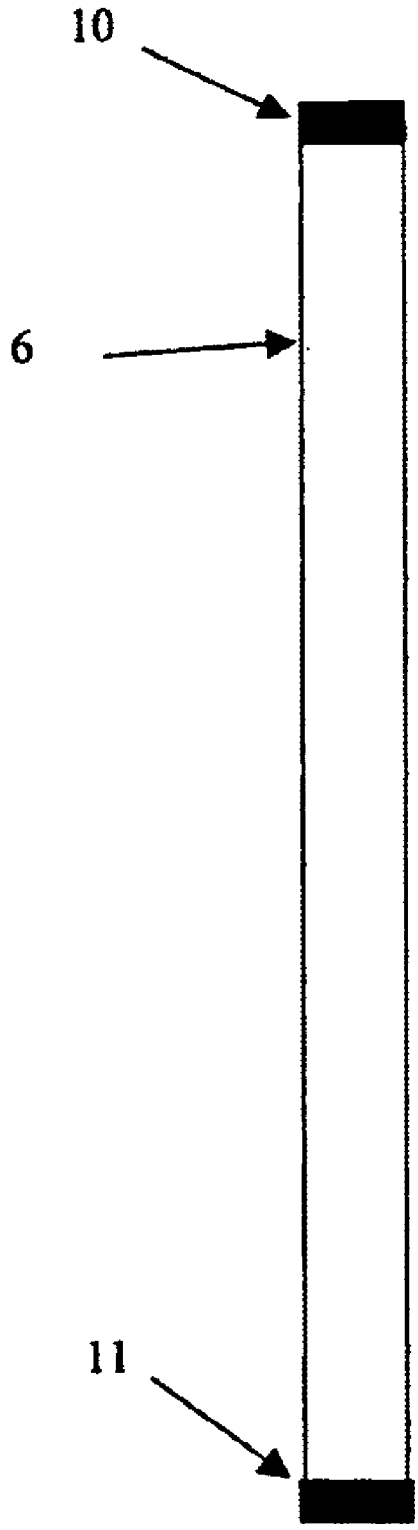
FIG. 9 is a plan view of the casing.

The second element of the present invention is a casing (6). The casing is to be comprised of a colored sheer or fish net type material capable of being compressed. At the top end of the casing (6) is an upper rubber band (10) or similar type binding process. At the lower end of the casing (6) is a lower rubber band (11) or similar type binding process. FIG. 9 illustrates a plan view of the casing (6) and details the location of the upper rubber band (10) and the lower rubber band (11).

In constructing the present invention, the casing is simply inserted over the retractable arm (7) of the retractable support element (1). The upper rubber band (10) of the casing (6) is inserted into the upper continuous notch (8) of the upper element (2) and the lower rubber band (11) of the casing (6) is inserted into the lower continuous notch (9) of the lower element (3). These connections are illustrated in FIGS. 7 and 8 respectively. The compressive force exerted by the rubber bands (10,11) holds the casing (6) in proper position.

To apply the present invention, the user simply inserts the lower extension (4) of the retractable support element (1) into the ground and then lifts the upper portion (2) in a vertical manner so that the retractable arm (7) becomes fully extended exposing the colored casing (6).

To store the present invention, the user simply pushes vertically downward on the upper portion (2) until the retractable arm (4) is fully compressed, then the retractable support element (1) is removed from the ground. Once this is completed the user then slides the lower extension (4) of one device into the corresponding slot (5) on the other device. Therefore, the two individual devices are stored as a one-piece unit.

As an alternative design, the present invention may only consist of a retractable support element (1) as illustrated in FIG. 4. In this scenario, the retractable support element is either painted a highly visible color or is made from a brightly colored plastic.

What is claimed:

1. A retractable target marker comprising:

(a retractable support element comprised of an upper portion which has a continuous indentation encircling its inner width, a retractable arm, a lower portion including a continuous indentation encircling its inner width, a lower protruding element and a receiving slot located on the oppose side of the lower protruding element, a semi-rectangular shaped casing made of a porous material, with a rubber-band type element affixed within its upper and lower ends;

the casing being fitted over the retractable support element;

the upper and lower ends of the casing being inserted into the continuous indentations of the upper and lower portions of the retractable support element;

wherein the compressive force of the rubber-band type elements of the upper and lower ends of the casing holds the casing affixed to the upper and lower portions of the retractable support element);

a retractable support element comprised of an upper portion which has an inner circular protrusion that contains a continuous notch encircling its width, a retractable arms a rectangular shaped lower portion which has an inner circular protrusion that contains a continuous notch encircling its width, a lower protruding extension and a receiving slot located on the rectangular face opposite the lower protruding element, a semi-rectangular shaped casing made of a porous material designed to allow for a rubber-band type bonding elements to be affixed within its upper and lower ends:

the casing being fitted over the retractable support element;

the upper and lower ends of the casing being inserted into the continuous notches of the upper and lower portions of the retractable support element;

wherein the compressive force of the rubber-band type elements of the upper and lower ends of the casing holds the casing affixed to the upper and lower portions of the retractable support element.

2. The retractable target maker of claim 1, wherein the retractable support element is (constructed by connecting threaded ends of the retractable arms into pre-made threaded holes in the upper and lower portions of the retractable support element). comprised of a retractable arm whose end pieces have pre-threaded ends that are inserted into pre-threaded holes in the upper and lower portions of the retractable support element.

3. The retractable target marker of claim 1, wherein the retractable support element is (constructed by connecting the two retractable arms) comprised of a retractable arm whose end pieces are inserted into pre-made holes in the upper and lower portions of the retractable support element by press-fit.

* * * * *